United States Patent [19]

Blake

[11] Patent Number: 4,597,091

[45] Date of Patent: Jun. 24, 1986

[54] PILL COUNTER

[76] Inventor: David J. Blake, 91 Blatchington Road, Hove, E. Sussex, England, BN3 3YG

[21] Appl. No.: 415,671

[22] Filed: Sep. 7, 1982

[51] Int. Cl.[4] ..... B65B 57/20; G06M 3/02

[52] U.S. Cl. ..... 377/6

[58] Field of Search ..... 377/6

[56] References Cited

U.S. PATENT DOCUMENTS

| | | | |
|---|---|---|---|
| 3,290,488 | 12/1966 | Sewell | 377/6 |
| 3,573,477 | 4/1971 | Klapes | 377/6 |
| 4,396,828 | 8/1983 | Dino et al. | 377/6 |

FOREIGN PATENT DOCUMENTS

| | | |
|---|---|---|
| 662552 | 12/1951 | United Kingdom . |
| 921711 | 3/1963 | United Kingdom . |
| 937612 | 9/1963 | United Kingdom . |
| 954333 | 4/1964 | United Kingdom . |
| 1172242 | 11/1969 | United Kingdom . |
| 1358378 | 7/1974 | United Kingdom . |
| 1486519 | 9/1977 | United Kingdom . |
| 1517290 | 7/1978 | United Kingdom . |

*Primary Examiner*—John S. Heyman

*Attorney, Agent, or Firm*—Vidas & Arrett

[57] ABSTRACT

Apparatus for counting small articles such as pills comprises a helical inclined plane having a pill receiving portion at or adjacent its upper end, pill detector means downstream of said pill receiving portion, said detector means being connected to a counter for giving a visual display of the number of pills passing over said detector means and pill collecting means for collecting pills after passage down said inclined plane, whereby pills deposited on said pill receiving portion are propelled under gravity down said inclined plane, are separated into substantially single file, are counted by said detector and counter means, and are collected in said collecting means.

9 Claims, 2 Drawing Figures

PILL COUNTER

The present invention relates to apparatus for counting small objects such as pharmaceutical pills.

When dispensing a prescription for a medicament which is formulated as unit doses, e.g. in the form of pills, tablets, capsules, dragees, or the like, the pharmacist has to remove the required number of unit doses from a bulk supply and place them in a smaller container. It is important that the counting is as accurate as possible, since the prescription is generally designed to last for a specific period of time, and the patient will become anxious if there are either too few or too many dosage units to complete the course of treatment which his physician has suggested.

Existing pill counting apparatus used by pharmacists generally relies on filling up a defined space with pills or other dosage unit. For example, many pills can be counted simply by filling up a V-shaped cut-out in a flat sheet of plastics material or the like. When the V-shaped space is full up to a graduation, it contains a definite number of pills. However such a device is only effective for pills of one size. Capsules can be counted by using a moulded sheet having a given number of depressions in it, each of which has to be filled with one capsule. Obviously such methods are slow, cumbersome and error-prone.

British Patent Specification No. 1,358,378 proposes a machine for counting articles such as pills wherein the stream of articles is divided into multiple separate streams by impinging on the vertex of a cone. The separate streams are then counted by detecting means, the outputs from all detectors being summed to give an output representing the total number of articles. In practice, sixteen separate counters are utilised. The complexity of this device renders it too costly for widespread use by pharmacists.

It is an object of the present invention to provide apparatus for counting small articles such as pills which is substantially less complex than the apparatus just described. For convenience the term "pill" will be used herein to cover tablets, capsules, dragees and other unit dose pharmaceutical formulations for oral administration.

In one aspect my invention provides apparatus for counting small articles such as pills comprising a helical inclined plane having a pill receiving portion at or adjacent its upper end, pill detector means downstream of said pill receiving portion, said detector means being connected to a counter for giving a visual display of the number of pills passing over said detector means and pill collecting means for collecting pills after passage down said inclined plane, whereby pills deposited on said pill receiving portion are propelled under gravity down said inclined plane, are separated into substantially single file, are counted by said detector and counter means, and are collected in said collecting means.

The inclined plane is helical; it may for example describe from one-quarter to one turn, e.g. about three-quarters of one turn (270°). The pitch and/or radius of the helix may vary over its length. Forming the inclined plane as a helix makes the apparatus much more compact and may assist in separating the pills.

The slope of the plane depends largely on the coefficient of friction between the material of which it is made and the articles, such as pills, which are to be counted. Generally a slope in the range of from 10° to 20°, e.g. about 15° will be satisfactory. It is advantageous to provide an increased angle of slope in the portion immediately upstream of the counting means. The pills are thereby accelerated and separated from each other, thus assisting counting.

In cross-section the inclined plane is preferably of arcuate form, since this facilitates the segregation of the pills into a single file stream. The cross-section may be approximately parabolic.

The pill receiving portion may have a lesser slope, so that the pills begin their descent relatively slowly, without any risk of jamming.

The detector means preferably comprises a photoresponsive device, the illumination of which is modulated by the pills to be detected. The illumination may be supplied by a separate illumination source or by ambient light. A system using infra-red light is of course equally usable. Thus the pills may be arranged to interrupt a light beam passing through an aperture, preferably a transverse slit, in the inclined plane. Alternatively the pills may be detected by reflected light, using a suitable optical system.

There are other detector means which can be used, employing any of the known types of proximity detector e.g. utilising capacitative or inductive effects, a beam of weak ionising radiation, ultrasonic means etc.

The output from the detector means is fed to a counter which displays the total. This counter will generally be of the electronic type utilising seven-segment displays of the LED or liquid crystal types.

The collecting means is preferably in the form of a tray having a pouring lip or spout for discharging the counted articles neatly into their final container. The tray may be provided with a handle or finger grip.

Conveniently, removal of the tray is arranged to reset the counter to zero. This may be effected by a suitably placed micro-switch or other switching means.

It is also possible for the apparatus to discharge the pills directly into their final container, which may be a jar, box, or other suitable receptacle.

It is preferable for the whole inclined plane to be exposed or at least easily accessible, so that it can be cleaned at frequent intervals to remove any possibility of cross-contamination between different prescriptions.

According to a further optional feature, the apparatus may comprise means to interrupt the discharge of pills into the collecting means when a desired number of pills has been counted. Thus in this embodiment the desired count is set on the apparatus by means of a numeric keyboard or the like, and when this count is reached the discharge of pills into the collecting means is automatically interrupted. The discharge of further pills may for instance be prevented by a mechanical shutter which blocks the exit from the inclined plane and/or diverts any excess pills into an overflow receiver, for return to the bulk store a mechanical shutter 10 (see FIG. 1) can be readily mounted in the assembly holding counter 6 and be activated upon counter 6 reaching a predetermined number of pills. For example, a mechanical shutter activated by an electro-magnet which in turn is activated by the counter is one such means of providing a blocking of pills once a predetermined number have been counted.

Using the apparatus according to the invention, it is possible to dispense a prescription of, for example, 100 pills in a few seconds, while counting this number of pills by manual methods requires an appreciable time.

An embodiment of my invention will now be described by way of example only with reference to the accompanying drawings herein:

Figure 1:
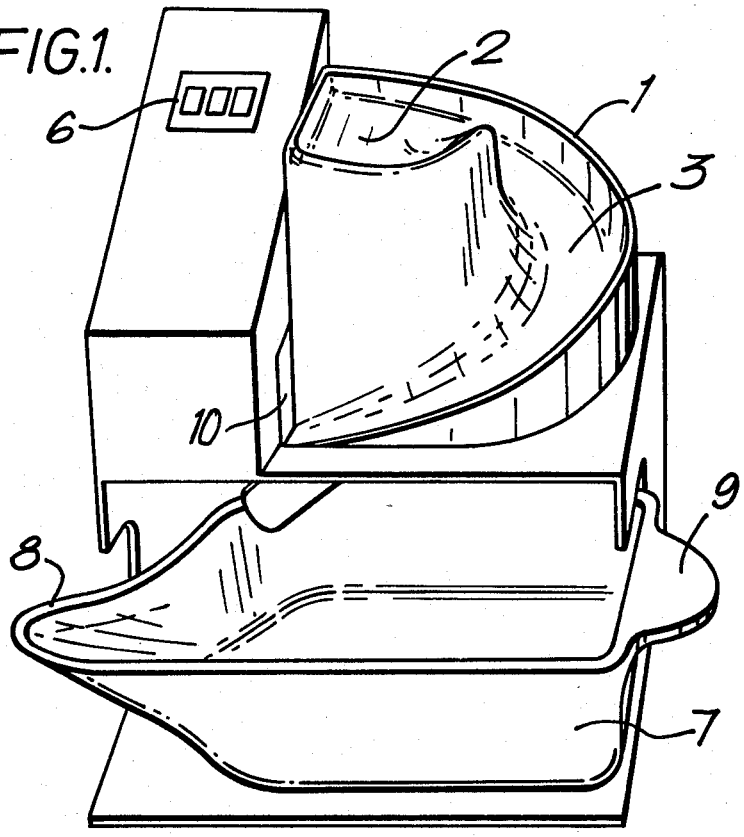
FIG. 1 illustrates the apparatus diagrammatically in perspective view.
Figure 2:
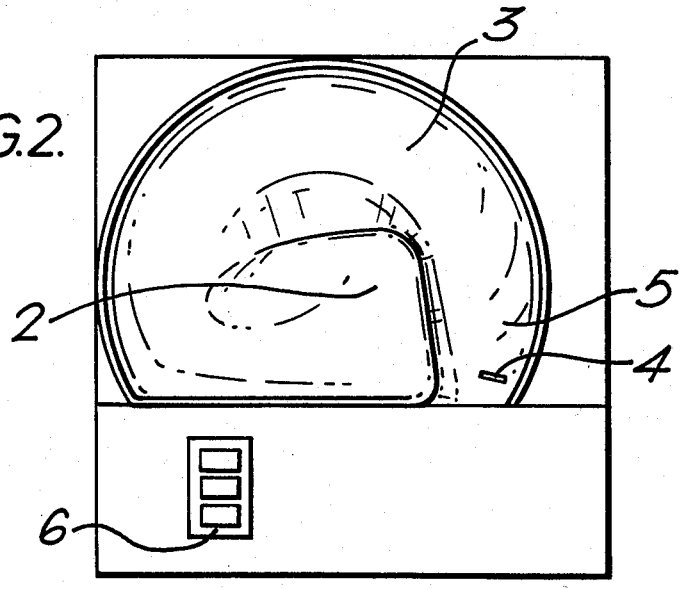
FIG. 2 is a plan view of the inclined plane.

Referring now to the drawings, the apparatus comprises an inclined plane 1 having a pill receiving portion 2 at its upper end. The pill receiving portion 2 is a relatively flat area which is smoothly united with the arcuate, approximately, parabolic portion 3. Pills poured from a bulk container onto the portion 2 are segregated into a single file stream and are propelled by gravity down the arcuate portion 3 and pass over a slit 4 extending transverse to the plane. The portion 3 has an inclination of about 14° to the horizontal, while portion 5 immediately upstream of the slit 4 has a somewhat greater inclination.

A beam of light (not shown) passes through slit 4 onto a photo-resistor. The output from the photo-resistor is then displayed on counter 6 as a total.

The pills leave the inclined plane and are received in collector means 7 in the form of a tray having a pouring lip 8 and a finger grip 9. A microswitch (not shown) is arranged to reset the counter when the tray 7 is removed in order to discharge its contents.

The structural portions of the apparatus may all be formed of plastics mouldings.

I claim:

1. Apparatus for counting small articles such as pills comprising a helical inclined ramp with said ramp being an arcuate form in cross-section and having a pill receiving portion at or adjacent its upper end, pill detector means downstream of said pill receiving portion, said detector means being connected to a counter for giving a visual display of the number of pills passing over said detector means and pill collecting means for collecting pills after passage down said inclined ramp, whereby pills deposited on said pill receiving portion are propelled under gravity down said inclined ramp, are separated into substantially single file, are counted by said detector and counter means, and are collected to said collecting means.

2. Apparatus according to claim 1 wherein said helical inclined ramp describes from one quarter to one turn.

3. Apparatus according to claim 2 wherein the portion of said inclined ramp immediately upstream of the counting means has an increased angle of slope.

4. Apparatus according to claim 3 wherein said pill receiving portion of said inclined plane has a lesser slope.

5. Apparatus according to claim 1 wherein said detector means comprises a photoresponsive device the illumination of which is modulated by the articles to be detected.

6. Apparatus according to claim 5 wherein the articles to be detected pass over an illuminated slit in said inclined plane, light from said slit being arranged to fall on said photoresponsive device.

7. Apparatus according to claim 1 wherein said collecting means is in the form of a tray having a pouring lip or spout for discharging the counted articles.

8. Apparatus according to claim 7 wherein removal of said tray is arranged to reset said counter to zero.

9. Apparatus according to claim 1 including means to interrupt the discharge of articles into said collecting means when a desired number of articles has been counted.

* * * * *